United States Patent [19]

Kaneko

[11] 4,347,977

[45] Sep. 7, 1982

[54] TEMPERATURE RESPONSIVE EXPANSION VALVE

[75] Inventor: Morio Kaneko, Hidaka, Japan

[73] Assignee: Kabushiki Kaisha Saginomiya Seisakusho, Tokyo, Japan

[21] Appl. No.: 290,230

[22] Filed: Aug. 5, 1981

[51] Int. Cl.[3] ..... F25B 41/04

[52] U.S. Cl. ..... 236/92 B; 62/225; 137/503

[58] Field of Search ..... 236/92 B; 62/225; 137/503

[56] References Cited

U.S. PATENT DOCUMENTS

| | | | |
|---|---|---|---|
| 1,990,663 | 2/1935 | Muffly | 236/92 B X |
| 2,297,872 | 10/1942 | Carter et al. | 236/92 B X |
| 2,298,150 | 10/1942 | Newton | 236/92 B X |
| 2,463,951 | 3/1949 | Carter | 236/92 B X |
| 2,506,724 | 5/1950 | Lindgren | 236/92 B |
| 3,099,140 | 7/1963 | Leimbach | 236/92 B X |
| 3,111,816 | 11/1963 | Tilney et al. | 236/92 B X |
| 3,138,174 | 6/1964 | Gilpin | 137/503 X |

*Primary Examiner*—William E. Tapolcai

[57] ABSTRACT

A temperature responsive expansion valve. The opening degree of a first valve body is adjusted by comparing an actual superheating degree with a predetermined reference superheating degree. A temperature responsive expansion valve comprises a valve needle disposed within the first valve body, said valve needle being driven by a difference between the refrigerant pressure on the primary side and the refrigerant pressure on the secondary side, said valve needle moving to enlarge the area of flow path within the valve opening when the pressure differential between the primary and secondary sides is smaller than a predetermined reference value.

7 Claims, 3 Drawing Figures

TEMPERATURE RESPONSIVE EXPANSION VALVE

BACKGROUND OF THE INVENTION

The present invention generally relates to a temperature responsive expansion value and, more particularly, to an expansion valve of the type which is furnished with a mechanism to make up for a drop in the condensation pressure attributable to that in the atmospheric temperature in wintertime and thereby control the amount of refrigerant supply to a predetermined constant amount for a given superheating degree.

In a refrigeration system, pressure at the evaporator remains substantially at a constant level without being affected very much by atmospheric temperature which may vary greatly between summertime and wintertime for instance. However, pressure at the condenser undergoes a significant variation in relation to the condensation temperature. Particularly in an air cooled condenser, it is known to build up a pressure in summertime which is several times the pressure in wintertime due to the difference in atmospheric temperature. Supposing that an expansion valve incorporated in the refrigeration system maintains a given opening degree, a larger difference in pressure permits a larger amount of refrigerant to flow therethrough. It will therefore be seen that, with a specific expansion valve designed to suit its operation in summertime for example, the amount of fluid flow allowed therethrough will become short in wintertime when the atmospheric temperature is generally far lower than in summertime even though the opening degree of the valve may be the largest which corresponds to a predetermined maximum superheating degree.

SUMMARY OF THE INVENTION

It is therefore an object of the present invention to provide a temperature responsive expansion valve principally designed for use in summertime which is provided with a mechanism to compensate for a decrease in the flow rate of regrigerant which will in wintertime cause a drop in the condensation pressure, so that fluctuation in the operational characteristics of the valve can be avoided or at least minimized against any fluctuation in the pressure at the condenser.

BRIEF DESCRIPTION OF THE DRAWINGS

The present invention will be described hereinafter with reference to the accompanying drawings in which.

DETAILED DESCRIPTION OF THE EMBODIMENT

Figure 1:
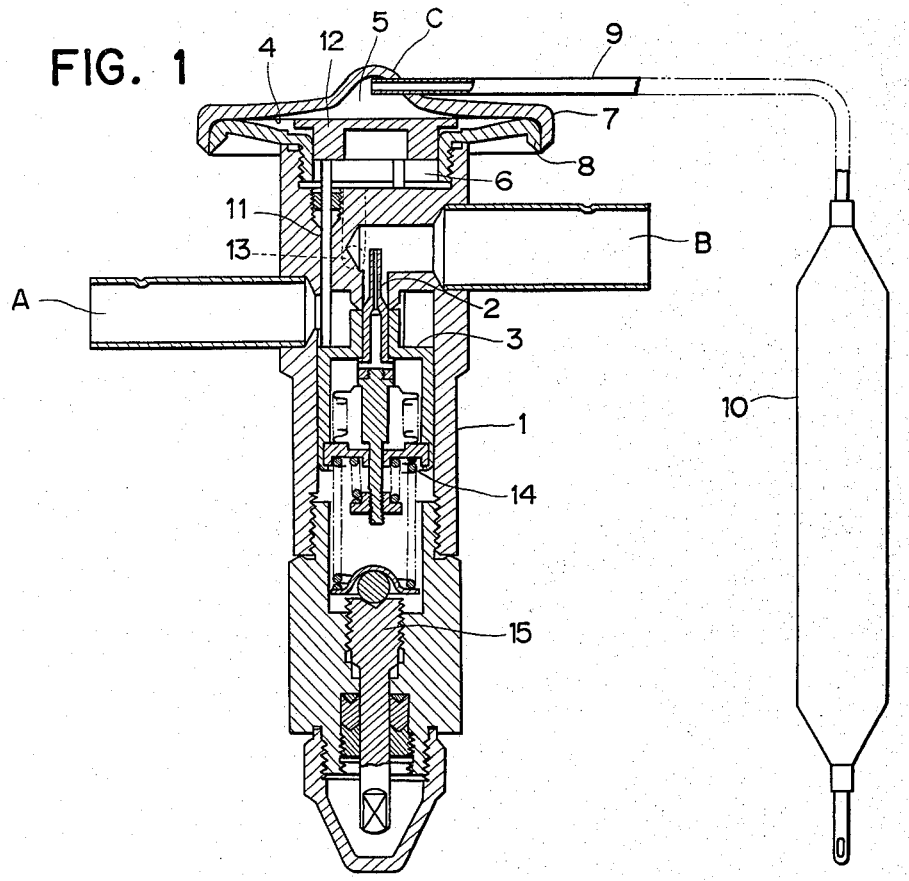
FIG. 1 is a section of an expansion valve embodying the present invention.
Figure 2:
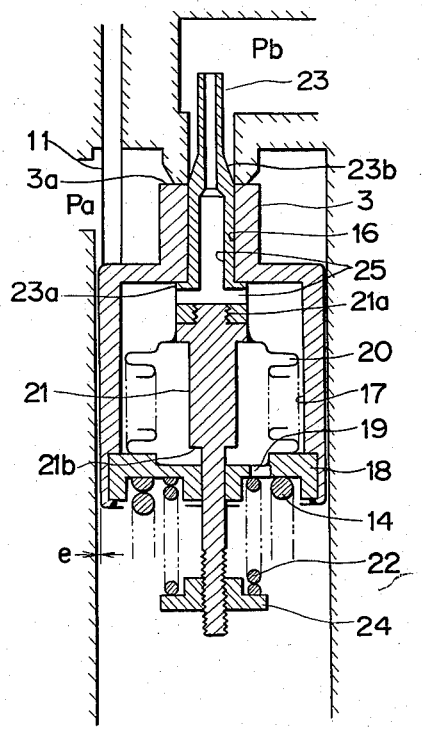
FIG. 2 is a fragmentary enlarged section of the expansion valve shown in FIG. 1.

A preferred embodiment of the expansion valve according to the present invention is shown in FIG. 1. FIG. 2 illustrates the expansion valve in a fragmentary enlarged section.

The expansion valve comprises a hollow valve body 1 which communicates with a refrigerant inlet passageway or conduit A at one side and with a refrigerant outlet passageway or conduit B at the other side. The inlet and outlet conduits A and B are communicatable with each other through a channel 2 which is formed in the body 1 to be blocked and unblocked by a first valve member 3 which is freely slidable within and along the inner wall of the valve body 1. Fixed to the upper end of the valve body 1 is a diaphragm assembly C which is made up of a flexible diaphragm member 4, an upper housing part or cover 7 and lower housing part or cover 8. The upper and lower covers 7 and 8 are securely connected together holding the peripheral edge of the diaphragm member 4 sealingly therebetween. The diaphragm member 4 defines an upper pressure chamber 5 and a lower pressure chamber 6 on opposite sides thereof in cooperation with the housing 7, 8 of the diaphragm assembly C. A temperature sensor 10 is disposed in piping (not shown) which extends from the outlet of an evaporator. The temperature sensor 10 envelops working gas therein while being held in fluid communication with the upper pressure chamber 5 of the diaphragm assembly by a capillary tube 9. The chamber 5 will thus be supplied with the saturation pressure $P_1$ of the working gas in the temperature sensor 10 and which corresponds to the temperature inside the outlet piping where the temperature sensor 10 is located. A passageway or conduit 13 opens into the lower pressure chamber 6 to communicate a pressure $P_2$ built up at the outlet of the evaporator thereinto. A movement of the diaphragm 4 will be transmitted to the first valve member 3 by a rod 11 through a metal fitting 12.

A spring 14 for adjustment of superheating degree is seated on the underside of the first valve member 3 with a predetermined preload $P_3$ to constantly bias the valve member 3 upward toward a position where it will block the channel 2 of the valve body 1. The preload $P_3$ of this spring is adjustable through a small adjustment screw 15 which is threaded into the valve body 1 from below as indicated in FIG. 1, the preload $P_3$ in turn determining a reference superheating degree.

The construction described so far performs the operations of an ordinary temperature responsive expansion valve in adjusting the position or opening degree of the valve member 3 against the counter force of the spring 14 is conformity with a change in the actual superheating degree. This actual superheating degree is represented by a difference $\Delta P$ between the pressures $P_1$ and $P_2$, $P_1 - P_2 = \Delta P$.

The first valve member 3 is formed as a hollow cylindrical member which is open at opposite ends and made up of a larger diameter portion and a smaller diameter portion which connect to each other through an intermediate shoulder. The upper end of the smaller diameter portion constitutes a flat valve 3*a* which is movable into or out of contact with a valve seat 26 on the valve body 1 in relation with the reference and actual superheating degrees, thereby closing or opening the channel 2 in the valve body 1. A spring retainer 18 is received in the open end of the larger diameter portion of the valve member 3 and welded together along its circumferential edge. The adjustment spring 14 already mentioned is seated on this spring retainer 18. The larger diameter portion of the valve member 3 defines thereinside a chamber 17 in which a bellows 20 is received with its one end rigidly connected to the spring retainer 18.

A valve stem 21 extends axially throughout the bellows 20 and the spring retainer 18 on which the bellows 20 is rigid. The free end of the bellows 20 remote from the spring retainer 18 retains the valve stem 21 rigidly therewith. An upper portion of the valve stem 21 emerging from the bellows 20 is threaded as at 21*a* to be coupled with a second valve member which is formed as a valve needle 23 as will be described. A lower portion of the valve stem 21 projecting from the spring retainer 18 is also threaded to carry a second spring retainer 24 therewith. Surrounded by the spring 14, the spring retainer 24 is adapted to retain one end of a second spring 22 the other end of which is seated on the common spring retainer 18. The valve stem 21 therefore is constantly biased downward by the second spring 22 which is disposed inside the first spring 14. The spring retainer 18 is formed with an aperture 19 which provides fluid communication between the interior of the bellows 20 and the primary side of the expansion valve outside the chamber 17, i.e. refrigerant inlet conduit A.

As described, the second valve member or valve needle 23 is engaged with the upper threaded portion 21*a* of the valve stem 21. The valve needle 23 is slidable up and down in a central through bore 16 of the smaller diameter portion of the first valve member 3. The distance the valve needle 23 is capable of moving upward in the bore 16 is limited by the inner upper wall of the valve member 3 or upper end of the chamber 17 which will be engaged by a radially outwardly extending shoulder 23*a* on the valve needle 23. A passageway 25 extending throughout the valve needle 23 is communicated at one end with the secondary side or outlet conduit B and at the other end with the chamber 17 of the first valve member 3. Furthermore, the valve needle 23 includes an upwardly tapered section 23*b* whose end having the largest diameter will become flush with the upper end of the smaller diameter portion of the first valve member 3 upon engagement of the shoulder 23*a* with the upper end of the chamber 17.

In operation, a pressure Pb in the outlet conduit B is admitted in the chamber 17 of the valve member 3 via the passageway 25 of the valve needle 23 to act on the outer periphery of the bellows 20. The valve needle 23 integral with the bellows 20 is thus biased downward by the pressure Pb plus the spring force Ps of the spring 22, i.e. $Pb+Ps$. A pressure Pa in the inlet conduit A on the other hand is introduced into the clearance e between the outer wall of the valve member 3 and the inner wall of the valve body 1 and therefrom into the bellows 20 via the aperture 19 in the valve seat 18. This pressure Pa inside the bellows 20 tends to move the bellows and, therefore, the valve needle 23 upward against the composite force $Pb+Ps$.

Accordingly, if the pressure differential $\Delta P$ between the inside and outside of the bellows 20 expressed as $Pa-Pb=\Delta P$ is determined to be a given value and if the spring force Ps of the spring 22 is so adjusted as to be equalized with the pressure differential $\Delta P$, equilibrium is established expressed as $Pa-Pb=Ps$. Under this condition, the valve needle 23 remains stationary with its shoulder 23*a* abutted against the inner upper wall of the valve member 3 as indicated in FIG. 2. When the pressure differential $\Delta P$ grows larger than the spring force Ps of the spring 22, that is, when the pressure Pa in the inlet conduit A is intensified, the valve needle 23 maintains the same position as that in the equilibrium condition with the shoulder 23*a* retained by the valve member 3 though the increased pressure differential $\Delta P$ tends to move it upward. As the pressure differential $\Delta P$ is reduced beyond the spring force Ps, that is, upon a drop of the inlet pressure Pa, it causes the valve needle 23 to move downward until a smaller diameter portion of the tapered section 23*b* shows itself in the refrigerant flow passage. This enlarges the effective area of the refrigerant flow passage.

Figure 3:
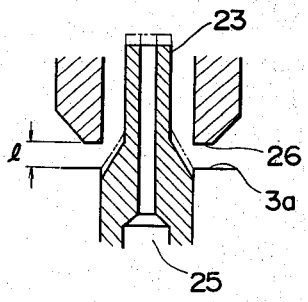
FIG. 3 is a fragmentary enlarged section showing different positions of a valve needle included in the expansion valve.

More specifically, suppose that the flat valve 3*a* on the valve member 3 is spaced a distance l from the valve seat 26 on the valve body 1 in accordance with a given relation between the reference and actual superheating degrees. When the pressure differential between the inlet conduit A or primary side and the outlet conduit B or secondary side is larger than a predetermined reference value, it maintains the valve needle 23 in a raised position indicated by a phantom line in FIG. 3. Upon a decrease in the pressure differential beyond the reference value, the valve needle 23 is lowered to a position indicated by a solid line in the same figure. It will thus be seen that the effective area of the refrigerant flow passage is enlarged by the decrease in the pressure differential though the distance or opening degree l of the first valve 3*a*, 26 remains the same, compensating for the decrease in the pressure differential and thereby allowing only a minimized range of flow rate variation or entirely reducing it to zero.

It will be appreciated from the foregoing that, even with a design for principle use in summertime, an expansion valve according to the present invention can maintain a constant area of refrigerant flow passage or minimize the range of its fluctuation even if the pressure on the primary side of the valve grows lower in wintertime due to a fall of the atmospheric temperature. In short, the expansion valve of the invention is properly operable in all seasons against any variation in the condensation pressure.

What is claimed is:

1. A temperature responsive expansion valve comprising a valve body having a channel therein and inlet and outlet conduits communicatable with each other through said channel;

a first valve member slidable within said valve body on an inlet side of the channel, said first valve member being normally biased to seat on the channel, having a central bore therein, and defining a chamber in communication with said central bore;

means for counteracting said biased first valve member in response to a temperature in the outlet conduits, a second valve member slidably provided through said central bore and including a larger diameter section normally biased to seat on the channel and a smaller diameter section, substantially extending through the channel, said second valve member having a passageway to provide communication between the outlet conduit and the chamber;

a bellows provided in said chamber and having a free end coupled with the second valve member; and means for providing communication between said inlet conduit and an open end of said bellows.

2. A temperature responsive expansion valve according to claim 1, wherein said first valve member includes a larger diameter section and a smaller diameter section, said larger diameter section defining the chamber and said smaller diameter being formed with the central bore.

3. A temperature responsive expansion valve according to claim 2, wherein said second valve member has a shoulder to engage the smaller diameter section.

4. A temperature responsive expansion valve according to claim 1, further including a first spring retainer fixed to an open end of the larger diameter section of the first valve member and having an aperture to provide fluid communication between the inlet conduit and an inside of the bellows, a first spring seated on said spring retainer at one end and adjustably supported at the other end within the valve body.

5. A temperature responsive expansion valve according to claim 4, further including a valve stem axially extending through said bellows and coupling the bellows with said second valve member at one end, said valve stem further extending through the first spring retainer; a second spring retainer carried by said valve stem at another end thereof; and a second spring provided between said first spring retainer and second spring retainer.

6. A temperature responsive expansion valve according to claim 5, wherein said second has a force equal to a predetermined pressure differential between the inlet conduit and the outlet conduit.

7. A temperature responsive expansion valve according to claim 1, wherein said second valve member includes a tapered section between the larger diameter section and the smaller diameter section.

* * * * *